US007651048B2

(12) United States Patent
Colombi et al.

(10) Patent No.: US 7,651,048 B2
(45) Date of Patent: Jan. 26, 2010

(54) SYSTEM AND ELEMENT FOR LATERALLY POSITIONING PAPER ROLLS OF DIFFERENT WIDTH

(75) Inventors: Alberto Colombi, Ivrea (IT); Marco Dellea, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 693 days.

(21) Appl. No.: 10/579,826

(22) PCT Filed: Nov. 16, 2004

(86) PCT No.: PCT/IT2004/000633

§ 371 (c)(1),
(2), (4) Date: May 17, 2006

(87) PCT Pub. No.: WO2005/047152

PCT Pub. Date: May 26, 2005

(65) Prior Publication Data

US 2007/0069063 A1 Mar. 29, 2007

(30) Foreign Application Priority Data

Nov. 17, 2003 (IT) ..... TO20030182 U

(51) Int. Cl.
*B65H 75/00* (2006.01)

(52) U.S. Cl. ..... 242/595; 400/613; 101/128; 101/128.1

(58) Field of Classification Search ..... 242/595, 242/595.1, 596.8, 598.5; 400/242, 243, 246, 400/613, 613.1; 101/128, 128.1, 128.4
See application file for complete search history.

(56) References Cited

U.S. PATENT DOCUMENTS 2,730,310 A 1/1956 Schultz (Continued)

FOREIGN PATENT DOCUMENTS

JP 60 161851 A 8/1985

(Continued)

*Primary Examiner*—William A Rivera
(74) *Attorney, Agent, or Firm*—Venable LLP; Robert Kinberg; Steven J. Schwarz

(57) ABSTRACT

In a receipt printer (10), suitable for printing on a paper ribbon of different widths, wound on a roll (14) arranged in a seat (15, 22, 23, 24) in the printer, a wall is provided for the lateral positioning (18, 30) of the roll of paper (14) in its seat, to keep the paper ribbons, or the respective rolls (14*a*, 14*b*) of at least two different widths in the proper printing position, independently of the width of the ribbon; the positioning wall (18) is arranged inside the seat (15) of the roll of paper, with a first surface (44) facing a side (26') of the same roll (14*a*). When the roll (14*a*) is replaced with another roll (14*b*) of different width, the positioning wall (18) is repositioned in the seat (15, 22, 23, 24), rotated through 180°, to laterally retain the new roll (14*b*) with the second face (45), opposite the first face (44); the positioning wall (18) is suitable for being attached to the walls (22, 23, 24) of the seat (15) through flat tabs (38, 39, 40), protruding beyond the edge (32) of the positioning wall (18); the positioning tabs (38, 39, 40) are all arranged staggered on one side (44), with respect to the median plane of the wall (18) and flush with one (44) of the two faces of the positioning wall (18) and are also suitable for engaging corresponding pairs of slots (41, 42, 43) formed in the walls of the seat (15).

15 Claims, 6 Drawing Sheets

U.S. PATENT DOCUMENTS

| | | | | | |
|---|---|---|---|---|---|
| 3,411,734 | A | * | 11/1968 | Greenberg et al. | 242/599.3 |
| 4,246,817 | A | * | 1/1981 | Marsh et al. | 242/595.1 |
| 5,174,518 | A | * | 12/1992 | Hongo et al. | 242/595 |
| 5,279,472 | A | | 1/1994 | Hongo et al. | |
| 5,974,963 | A | * | 11/1999 | Kawai | 101/128.1 |
| 6,561,453 | B1 | | 5/2003 | Shinga | |
| 6,974,060 | B2 | * | 12/2005 | Gomes et al. | 242/594.3 |
| 7,111,806 | B2 | * | 9/2006 | Craig | 242/118.5 |

FOREIGN PATENT DOCUMENTS

| | | | |
|---|---|---|---|
| JP | 06 293451 | A | 10/1994 |
| JP | 09 002709 | A | 1/1997 |
| JP | 2001 117178 | A | 4/2001 |
| WO | WO-2004/113088 | | 12/2004 |

* cited by examiner

SYSTEM AND ELEMENT FOR LATERALLY POSITIONING PAPER ROLLS OF DIFFERENT WIDTH

TECHNOLOGICAL FIELD OF THE INVENTION

This invention relates to a system for laterally retaining paper rolls of different width and a relative lateral positioning element, wherein said lateral positioning element consists of a wall of a seat for the paper rolls, movable and re-positionable in two distinct positions, suitable for retaining the rolls of different width.

Generally the invention is used to advantage on a printer of a type known in the art, for example a printer specialized for POS (Points Of Sale), of the type described in the international patent application no. PCT/IT2004/000360.

A printer of this type is preferably a conventional type, parallel, thermal printer, in which information is printed on a ribbon of treated paper, i.e. paper that is sensitive to heat, which unwinds from a roll placed in an appropriate seat inside the case of the printer; the roll of paper is arranged with its outer surface resting through gravity on inclining planes, arranged in the bottom of the seat, and which maintain the roll in a stable position, to guarantee correct unwinding of the ribbon during printing.

The roll of paper normally has a prefixed width, but in special cases rolls of different width may need to be used.

In any case, the paper rolls must be placed in the seat in a precise position, in which one side of each roll, independently of its width, rests against a fixed lateral wall of reference in the seat, while the opposite side of the roll is retained by a positioning element, for instance a second lateral wall of the seat, opposite the reference wall.

Depending on the particular width of the roll used, the second wall of the seat may be movable so as to be able to be placed in different lateral positions, that is, in staggered positions on the axial direction of the roll, in such a way as to prevent lateral movements of the roll.

BRIEF DESCRIPTION OF THE PRIOR ART

A printer of the type mentioned above is known in the current art, having a structure that is re-positionable laterally with respect to the paper roll, depending on the roll's width.

The structure is attached to the frame of the printer, for each value of the width of the roll, through a number of pins projecting from the structure and suitable for engaging in corresponding fixed slots; depending on whether the roll in use is broad, or narrow, the projecting pins engage the slots at one of their ends, or at the opposite end.

This known art structure for positioning paper rolls is complex to build and difficult to assemble, and also has the drawback that in situations of strong vibrations, or abrupt movements of the printer, the pins may shift from their original position, allowing the roll to move laterally, creating problems for the printing operations.

SUMMARY OF THE INVENTION

The main object therefore of this invention is to produce a system for laterally retaining paper rolls of different width, particularly for a printer, that is simple to build and easy to assemble, and without the drawbacks encountered in the known art.

Another object of the present invention is to produce a positioning element arranged in a seat and re-positionable in one or the other of two positions, for laterally retaining rolls of different width in the seat.

A further object of this invention is to produce a printer for paper rolls of different width, provided with a roll positioning element, arranged in the seat and re-positionable in one or the other of two positions, for laterally retaining rolls of different widths.

DETAILED DESCRIPTION OF A PREFERRED EMBODIMENT

With reference to the FIGS. 1-10, a printer is indicated with the generic numeral 10, of the type employed in Points Of Sale; in particular, the printer 10 is preferably thermal type, suitable for printing information on a ribbon of treated paper, which unwinds off a roll 14 (FIGS. 1-2) housed inside the case 16.

Figure 1:
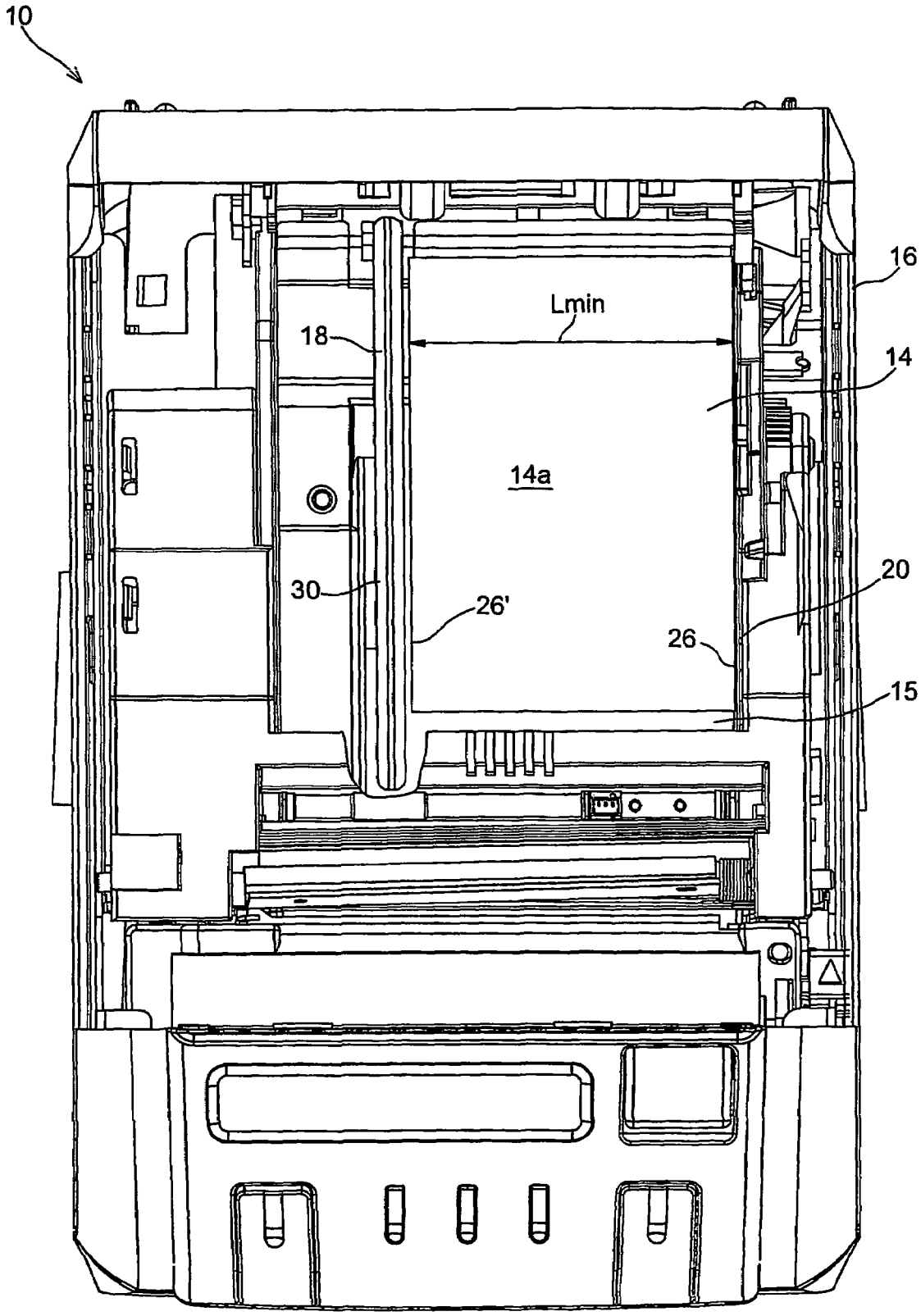
FIG. 1 represents an internal view of a printer in which a roll of paper of lesser width is retained by a lateral positioning element, according to the present invention.
Figure 2:
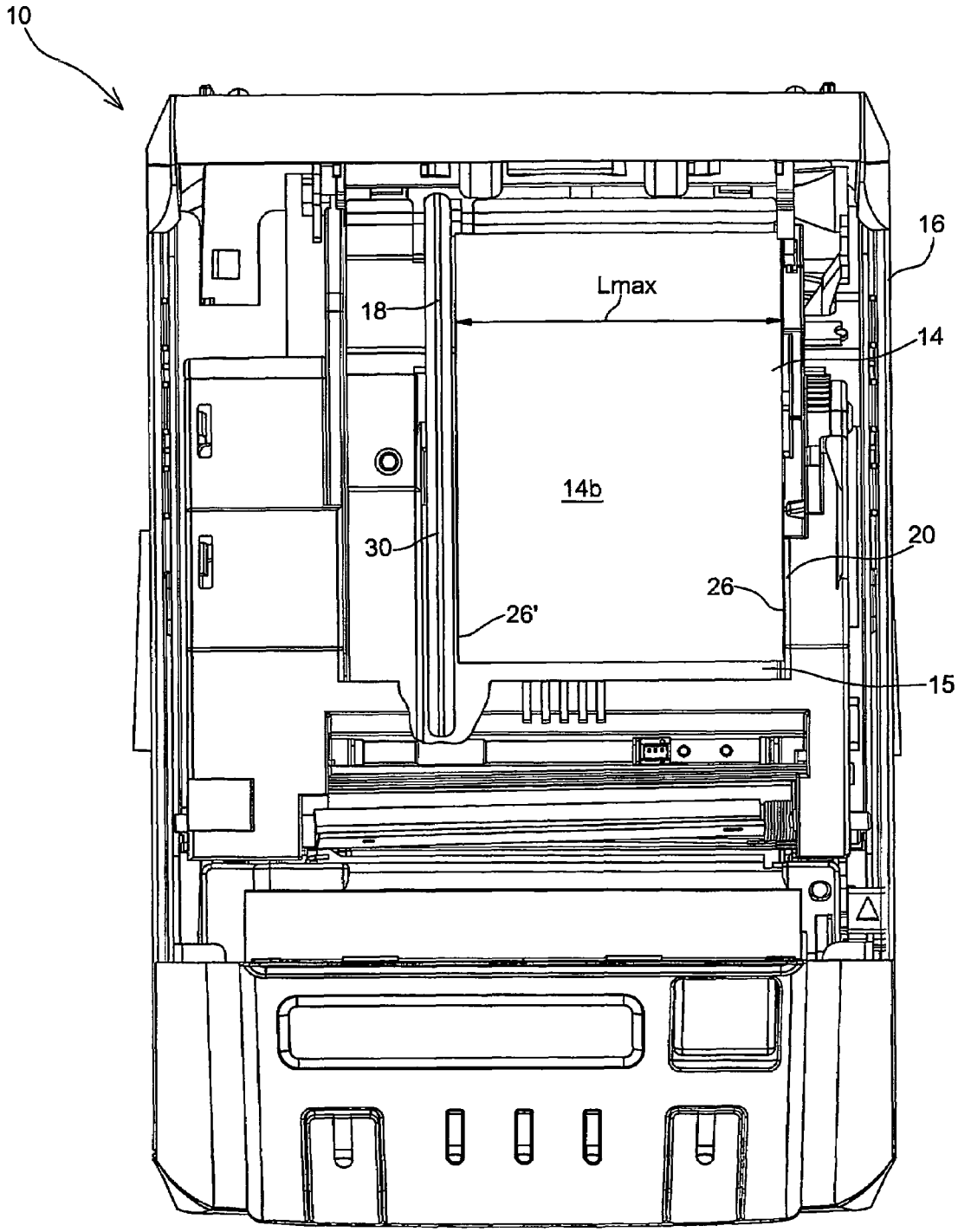
FIG. 2 represents an internal view of the printer of FIG. 1 in which a roll of paper of greater width is retained by the same lateral positioning element.

For clarity's sake, in FIGS. 1 and 2 a top part of the case 16 has been removed to show the inner configuration of the printer 10, and in particular the position of a lateral positioning element 18 of the roll 14, made, in accordance with the present invention as a non-restrictive example, of a rigid, flat wall 18.

The printer 10 comprises a seat 15 mounted on the case 16, arranged inside which is the paper roll 14; the seat 15 is bounded by two, opposite side walls 18 and 20 (FIGS. 1-5), the first which of which in particular is defined by the lateral positioning element 18, and by a bottom wall 22, suitable for supporting the roll 14, divided into various opposingly inclined support surfaces 23, 24, to offer the paper roll 14 a stable support.

The printer 10 also comprises a printing unit 25 (FIG. 5) of the parallel, thermal printing type, and a cutter unit 28, consisting of an automatic knife with movable blades, both of type known in the sector art, suitable for cutting off, after printing and feeding of the ribbon, a piece of the ribbon, or receipt.

The printer 10, according to the present invention, is provided for printing on paper ribbons of different widths, in particular on a ribbon of minimum width Lmin, wound on a roll 14*a*, indicated as "narrow" (FIG. 1), or on a ribbon of maximum width Lmax, wound on a roll 14*b*, indicated as "broad" (FIG. 2).

In accordance with recognized standards and values widely used throughout the sector of printers of this type, the paper rolls indicated as narrow can have a width of 58 mm, while those indicated as broad can have a slightly greater width of 60 mm.

As a result, the seat 15 must accommodate without problems paper rolls 14*a* and 14*b* having the corresponding different widths, while maintaining the lateral reference position of each roll unchanged.

In fact, for printing requirements, each roll of paper must be retained in the seat 15 in the same, exact lateral position, in which one side 26 of each of the rolls is placed adjacent, for example against the fixed lateral wall 20, and therefore to guarantee this exact lateral position of the roll, the positioning element 18 must be arranged in contact with the free side 26', opposite the reference side 26 of the roll 14*a*, or 14*b*, independently of the width of the roll in the seat 15.

According to the present invention, the positioning element 18 of the seat 15 is movable and can easily be repositioned manually by the operator, each time a new roll of paper of different width is inserted in the seat 15, in such a way as to laterally retain the new roll in the proper reference position for printing.

For this purpose, the lateral positioning element 18, or lateral wall 18, consists of a flat structure 30 (FIGS. 6-8), having a predefined thickness "S", and delimited by an edge, or outer profile, 32, which adapts perfectly to the inner shape of the seat 15.

The outer profile 32 of the positioning element 18 is symmetrically the mirror image of an axis of vertical symmetry AV; therefore, the positioning element 18 may be arranged in the seat 15 in one or the other of two positions 34, 35 (FIGS. 3, 4), both parallel to the wall 20, obtained by rotating the element 18 by 180° about the axis AV.

In each of the two positions 34, 35 (FIGS. 1-4), the positioning element 18 is secured to the front 36, rear 37 and bottom walls 22 by first fastening means 38, 39, 40 (FIGS. 6, 8), belonging to the positioning element 18, and suitable for cooperating with corresponding second fastening means 41, 42, 43 (FIGS. 3, 4), belonging to the seat 15.

Figure 5:
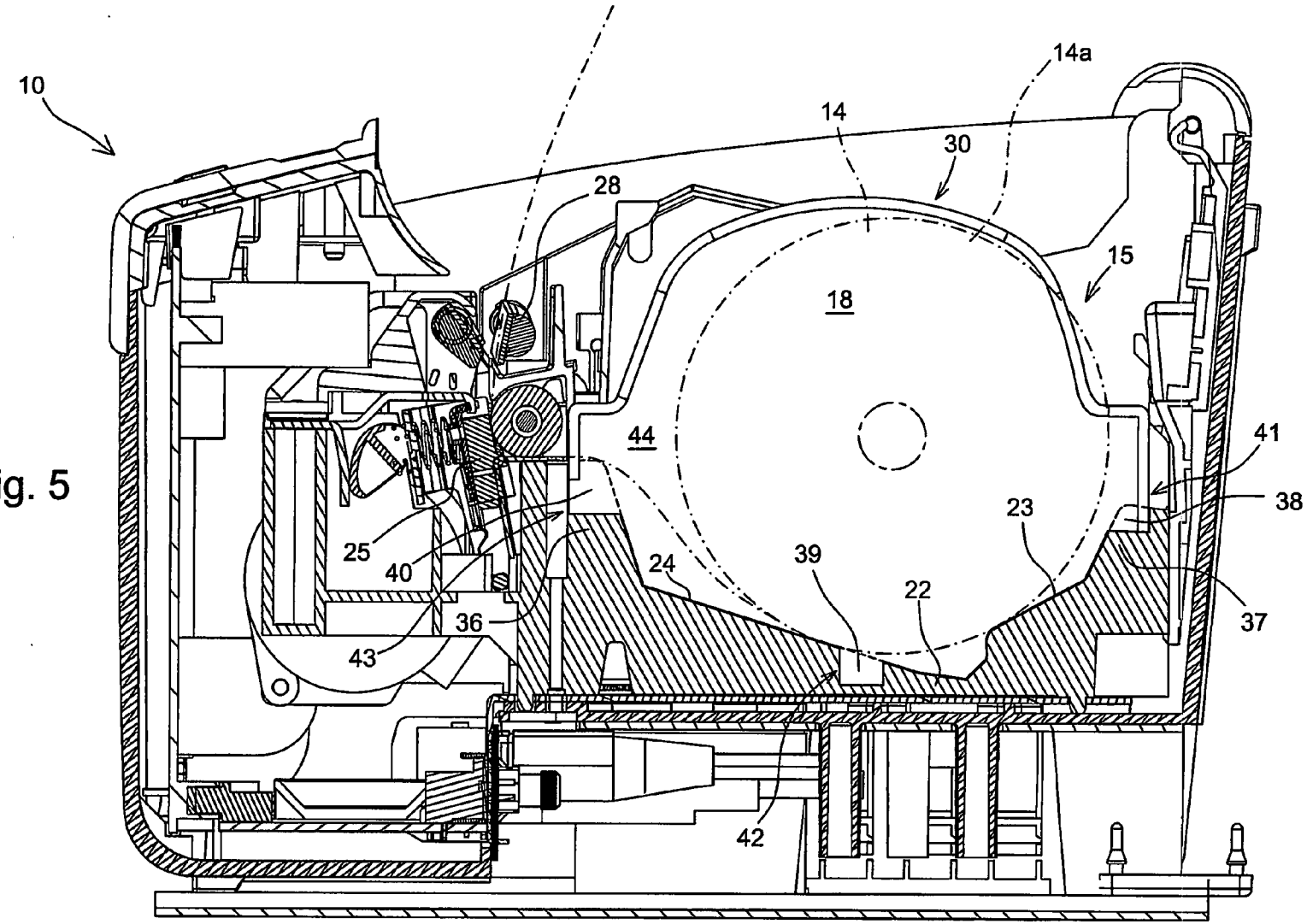
FIG. 5 shows a longitudinal section of the printer of FIG. 1.
Figure 8:
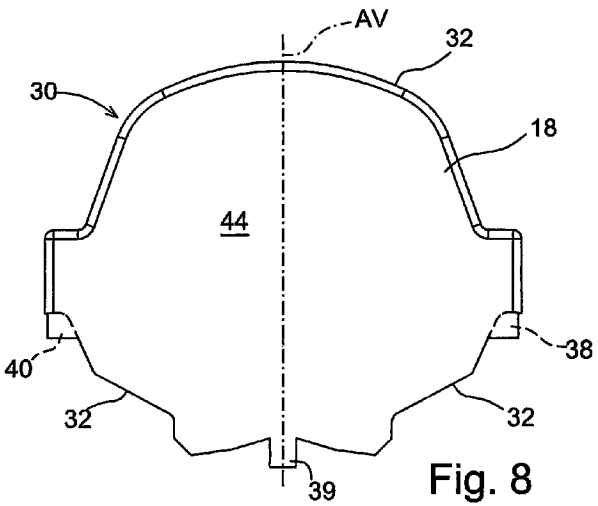
FIG. 8 is a front view of the opposite face of the positioning element of FIG. 6.
Figure 7:
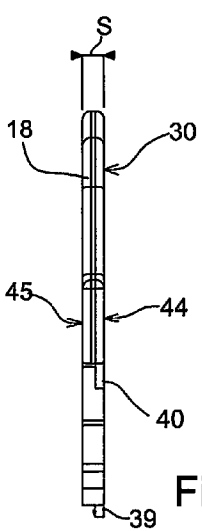
FIG. 7 is a cut view of the positioning element of FIG. 6.
Figure 6:
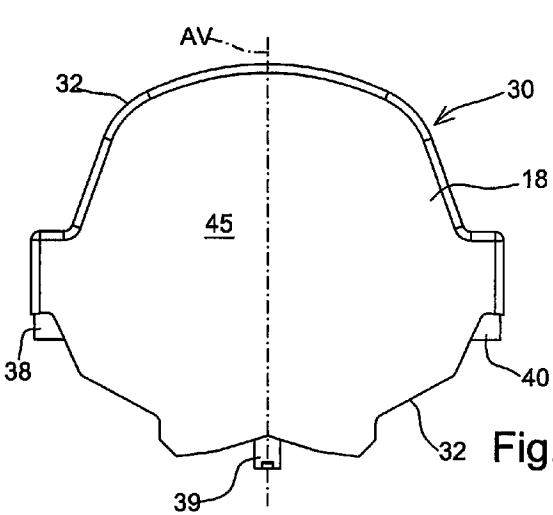
FIG. 6 is a front view of the positioning element according to the present invention.
Figure 10:
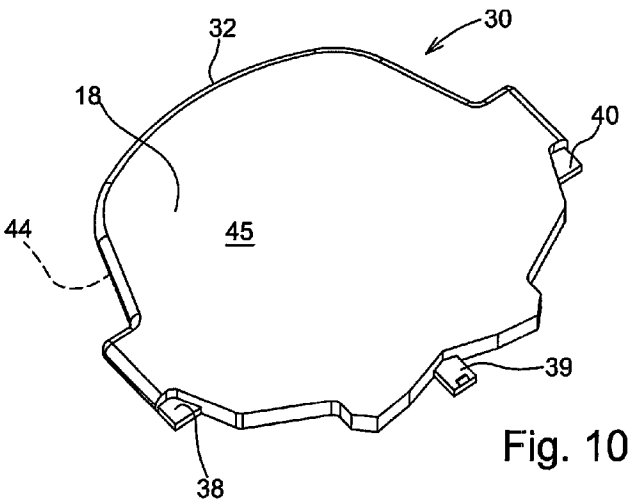
FIG. 10 is a perspective view of the positioning element according to the present invention.

According to a non-restrictive embodiment of this invention, the positioning element 18 consists of a flat wall 18, while the first fastening means 38, 39, 40 consist of at least three tabs, respectively 38, 39, 40, projecting beyond the profile 32 of the element 18 and suitable for engaging the corresponding second fastening means, in turn consisting of slots 41, 42 and 43, made respectively in the walls 36, 37, 22 of the seat 15 (FIG. 5).

The two lateral tabs 38, 40 are arranged each on a side of the positioning element 18, reciprocally opposite and symmetrical with respect to the axis AV, while the third tab 39 projects towards the bottom wall 22 and is arranged in a central part of the positioning element 18, so that it also is symmetrical with respect to the axis AV.

In particular, as described below in greater detail, the central tab 39 is suitable for engaging the slot 42, whatever the arrangement assumed by the positioning element 18, whereas the tabs 38 and 40 are suitable for respectively engaging the slots 41 and 43 or the slots 43 and 41, depending on one or the other of the two possible positions assumed by the positioning element 18.

According to a non-restrictive embodiment of this invention, the fastening means 41, 42, 43, integral with the seat 15, are each configured as a pair of slots side by side, indicated respectively with 41*a*, 41*b*; 42*a*, 42*b*; 43*a*, 43*b*, (FIGS. 3, 4), in which each of the slots has a width equal to the thickness "s1" of the corresponding tabs 38, 39, 40; and the slots of each pair are separated by a partitioning septum 47 (FIGS. 3, 4, 9), fastened to the walls of the seat 15.

For the purpose of obtaining correct positioning of the element 18, in order to laterally retain with precision one or the other of two rolls 14*a*, 14*b* of different width, the tabs 38, 39, 40, which constitute the fastening means of the positioning element 18, are arranged displaced towards a face of the positioning element 18, and in particular are arranged flush with the face 44 of the latter, which is in contact with the free side 26' of the narrow roll 14*a*.

Figure 9:
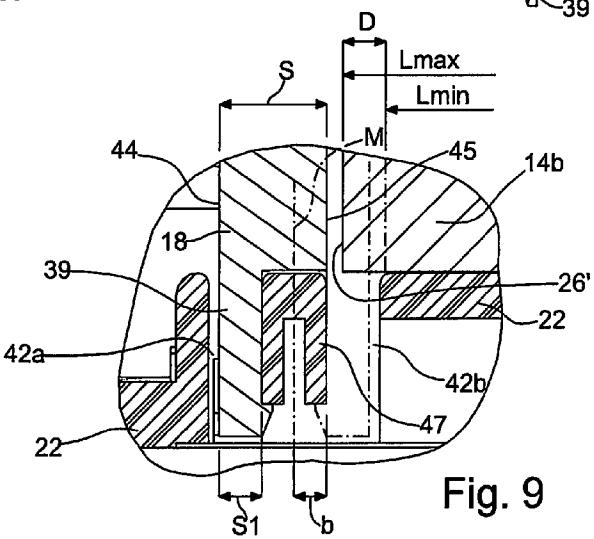
FIG. 9 is a section, taken according to the line IX-IX, representing an enlarged detail view of a projecting member of the positioning element of FIG. 4.

In addition the thickness "s1" of the tabs 38, 39, 40 is substantially equal to the difference "D" between the width "Lmax" of the broad roll 14*b* and that "Lmin" of the narrow roll 14*a* and must be less than the thickness "S" of the element 18 (FIG. 9).

As a result the median plane M of the partitioning septum 47 (FIGS. 4, 9) must be removed by an amount "b" from the face 45 of the wall 18, in contact with the side 26' of the broad roll 14*b* and respectively by an amount "s1+b" from the other face 44.

Figure 3:
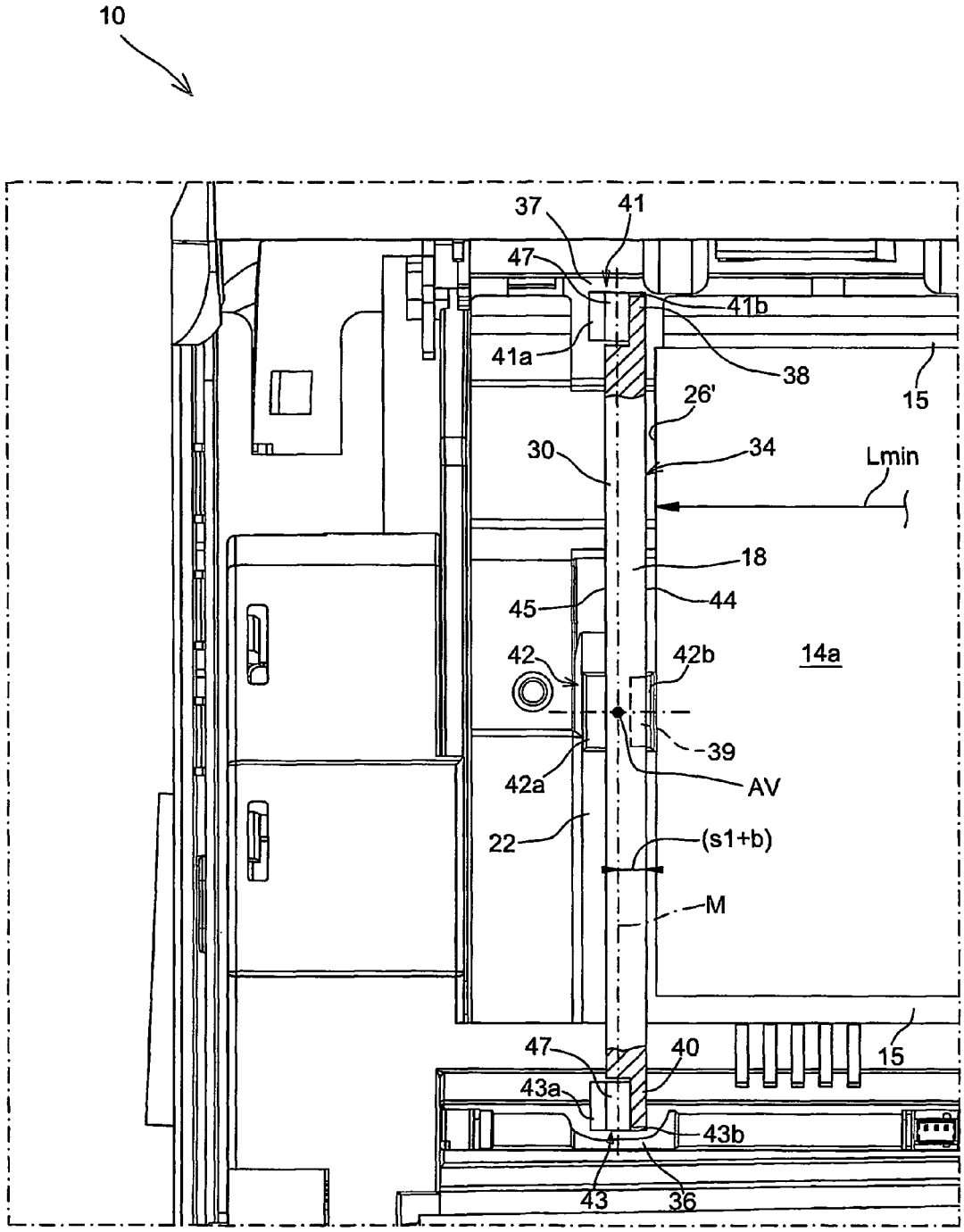
FIG. 3 is an enlarged scale, plan view of the lateral positioning element, in the configuration of FIG. 1.
Figure 4:
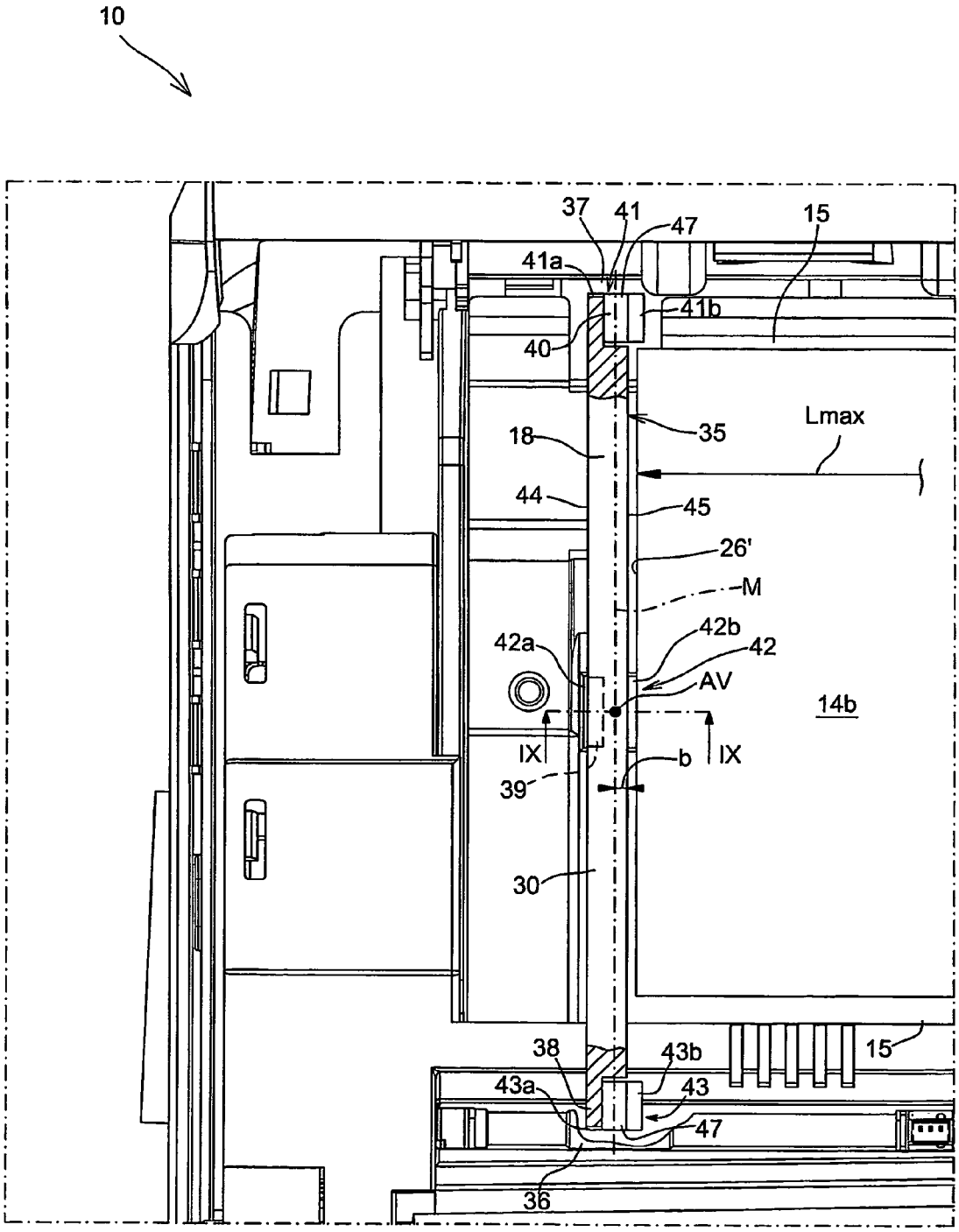
FIG. 4 is an enlarged scale, plan view of the lateral positioning element, in the configuration of FIG. 2.

In other words, the amount "b" corresponds to the distance between the median plane "M" of the partition 47 and the face 45 of the wall 18, intended to laterally retain the broad roll 14*b*, by cooperating in contact with the relative side 26' (FIG. 4); by the same token, the amount "s1+b" corresponds to the distance between the median plane "M" of the partition 47 and the other face 44 of the wall 18, intended to laterally retain the narrower roll 14*a*, by cooperating, again in this case, in contact with the relative side 26' (FIG. 3).

In general, the amount "b" equals: $b=\frac{1}{2}(S-D)$; whereas the amount s1 equals: $s1=S-2b$.

Therefore when a roll, for instance a narrow roll 14*a* (FIG. 3), is inserted in the seat 15, the element 18 is arranged in the position 34, in which the tabs 38, 39, 40 respectively engage the slots 41*b*, 42*b*, 43*b*, arranged closest to the roll 14*a*; in this position, the element 18 prevents lateral movements of the roll 14*a* through the face 44.

When on the other hand, a roll, for instance a broad roll 14*b* (FIG. 4, FIG. 9), is inserted in the seat 15, the element 18 is rotated by 180° about the axis "AV" and is arranged in the position 35, in which the tabs 38, 39, 40 respectively engage the slots 43*a*, 42*a*, 41*a*, arranged farthest from the roll 14*b*; in this position, the element 18 prevents lateral movements of the broad roll 14*b* through the face 45.

According to a different embodiment of the invention, each of the fastening means 41, 42 and 43 is made of a single slot of width "2b".

In this case the tabs 38, 39, 40 are again arranged displaced towards one side of the wall 18 and the median plane "M1" of each of the slots 41, 42, 43 is removed by an amount "b" from the position of the free side 26' of the broad roll 14*b*, whereas the thickness of the tabs 38, 39, 40 is of "2b".

For this different configuration as well, the same relation between the quantities "D", "S", "b" also applies, and is repeated below for convenience:

$$b=\frac{1}{2}(S-D).$$

It remains understood that changes may be made to the present invention, or parts added, or the shape altered, without exiting from the protective scope defined in the main claims.

For instance the fastening means 38, 39, 40 may be made from cylindrical pins, projecting laterally from the profile 32 of the positioning element 18, and downwards, their symmetrical position with respect both to the median plane "M" and to the "AV" axis remaining unaltered.

As a result the corresponding fastening means 41, 42 and 43 are made of holes of a diameter suitable for accommodating the relative pin; in particular, the diameter of the central pin, which faces downwards, must be equal to the amount "2b".

Further, according to another variant, the first fastening means 38, 39, 40 and the corresponding second fastening means 41, 42 and 43 could have a structure of a functionally dual nature with respect to that already described.

In particular the fastening means 38, 39, 40 integral with the positioning element 18 may be made from recesses or grooves, i.e. from parts having an embedded shape with respect to the outer profile of the element 18, whereas correspondingly the fastening means integral with the seat 15 can be made of parts or bodies projecting from the surface of the seat 15, with the embedded parts and the projecting parts complimentary in shape to one another, thus rendering the embedded parts formed on the element 18 suitable for accommodating the projecting parts of the seat 15 during assembly of the positioning element 18.

The invention claimed is:

1. System for laterally retaining paper rolls of different width in a printer, comprising a lateral positioning element and a seat of said printer suitable for alternatively accommodating one or the other of said rolls of different width, said lateral positioning element being suitable for assuming a first, or a second position, for retaining respectively a first narrow roll, or a second broad roll, said positioning element being fastened to said seat in each of said two positions by means of first fastening means, integral with said positioning element and suitable for cooperating with second fastening means, belonging to said seat, wherein said first fastening means are arranged towards a first side of said positioning element, said second fastening means comprise parts complementary to said first fastening means, and said positioning element is suitable for being rotated though 180° about a vertical axis of symmetry from said first position, in which said first narrow roll is retained by means of said first side of said element, to said second position, in which said second broad roll is retained by a second side, opposite said first side, of said positioning element, and vice versa.

2. System for laterally retaining paper rolls of different width according to claim 1, wherein said positioning element is made of a flat structure, having a predefined thickness "S" delimited by an external profile such as to be adaptable to the internal shape of said seat, said first fastening means comprise at least one body projecting beyond said profile, having a thickness "S1" lesser than the thickness "S" of said element, and said complementary parts of said second fastening means comprise at least one pair of slots arranged side by side, and separated by a partitioning septum fixed to said seat, wherein said at least one projecting body is suitable for selectively engaging a first or a second of said slots, when said positioning element is placed respectively in said first or in said second position.

3. System for laterally retaining paper rolls of different width according to claim 1, wherein said positioning element is made of a flat structure, having a predefined thickness "S" delimited by an external profile such as to be adaptable to the internal shape of said seat, and said first fastening means comprise at least three bodies projecting beyond said profile, having a thickness "S1" lesser than the thickness "S" of said positioning element, and arranged towards a first face of said positioning element, said second fastening means comprises at least three pairs of slots, formed in said seat, each constituted by two slots arranged side by side and separated by a partitioning septum fixed to the seat, and each of said projecting bodies is adapted for engaging a corresponding slot of each of said pairs of slots formed in said seat.

4. System for laterally retaining paper rolls of different width according to claim 3, wherein said at least three bodies are flush with said first face of said positioning element.

5. System for laterally retaining paper rolls of different width according to claim 3, wherein in said first position, said bodies respectively engage said slots, arranged closest to said narrow roll, and that in said second position, said bodies respectively engage said slots, arranged farthest from said broad roll.

6. System for laterally retaining paper rolls of different width according to claim 1, wherein said positioning element is made of a flat structure, having a predefined thickness "S" delimited by an external profile, which adapts to the internal shape of said seat, said first fastening means comprise at least one body projecting beyond said profile, having a thickness "S1" lesser than the thickness "S" of said element, and said complementary parts of said second fastening means define a single slot, in which said at least one projecting body is adapted for cooperating with opposite sides of said single slot, when said element is arranged respectively in said first or in said second position.

7. Lateral positioning element of paper rolls of different widths, arranged alternatively in a seat of a printer, said lateral positioning element being made of a flat structure having a predefined thickness "S", delimited by an external profile, which adapts to the internal shape of the seat, said lateral positioning element being suitable for assuming a first, or a second position, for respectively retaining a first narrow roll, or a second broad roll, said positioning element being fastened to said seat in each of said two positions by way of first fastening means, integral with said positioning element, and adapted for cooperating with corresponding second fastening means belonging to said seat, wherein said first fastening means comprise a plurality of bodies projecting beyond said profile, having a thickness "S1" lesser than the thickness "S" of said element, and arranged towards a first face of said positioning element, each of said projecting bodies being adapted for engaging, in each of said two positions, a corresponding slot of a pair of slots, of said second fastening means, set side by side and separated by a partitioning septum fixed to the seat, so that said positioning element is suitable for being moved from said first position, in which said first roll is retained by way of a first face of said positioning element, to said second position, in which said second roll is retained by a second face, opposite said first face, of said positioning element, by means of a 180° rotation about a vertical axis of symmetry, and vice versa.

8. Positioning element according to claim 7, wherein said plurality of bodies comprise at least three bodies projecting beyond said profile and arranged flush with said first face of said positioning element.

9. Lateral positioning element, according to claim 7, wherein, in said first position, said bodies respectively engage those, of said slots, which are placed closest to said narrow roll, and that in said second position, said bodies respectively engage those, of said slots, which are placed furthest from said broad roll.

10. Lateral positioning element, according to claim 9, wherein said projecting bodies consist of flat tabs, having a side flush with said first face of said positioning element.

11. Lateral positioning element, according to claim 9, wherein said projecting bodies consist of cylindrical bodies.

12. Lateral positioning element, according to claim 7, wherein two of said bodies are placed reciprocally opposite and symmetrical with respect to said axis, whereas said third body projects towards a bottom wall of said seat and is symmetrical with respect to said axis.

13. Lateral positioning element, according to claim 7, wherein the thickness of said tabs is equal to the difference between the width (LS) of said broad roll and the width (LM) of said narrow roll and must be lesser than the thickness of said element, said thickness also being equal to the width of each of said slots.

14. Lateral positioning element, according to claim 7, wherein said partitioning septum has a width equal to twice the distance between a median plane of said partitioning septum and said second face of said element, adjacent to a side of said broad roll, and said median plane comprises said axis of symmetry.

15. Printer for paper rolls of different width, comprising a seat suitable for alternatively accommodating a first narrow roll, or a second broad roll, said seat being delimited by a first lateral fixed wall, of reference for said rolls, and by a movable lateral positioning element, opposite said first wall, said lateral positioning element consisting of a flat structure having a predefined thickness "S", delimited by an external profile, which adapts to the internal shape of the seat, said lateral positioning element being suitable for assuming a first, or a second position, for respectively retaining said narrow roll, or said broad roll, said positioning element being secured to said seat, in each of said two positions, by way of first fastening means, integral with said positioning element, and suitable for cooperating with corresponding second fastening means belonging to said seat, wherein said first fastening means comprise at least three tabs, projecting beyond said profile and arranged towards a first face of said element, and said second fastening means comprise at least three corresponding pairs of slots, the slots of each pair being arranged side by side and separated by a partitioning septum, so that said positioning element is suitable for being rotated through 180° about a vertical axis of symmetry (AV) from said position, in which said first roll is retained by way of a first face of said element, to said position, in which said second roll is retained by a second face of said element.

* * * * *

UNITED STATES PATENT AND TRADEMARK OFFICE

CERTIFICATE OF CORRECTION

PATENT NO. : 7,651,048 B2
APPLICATION NO. : 10/579826
DATED : January 26, 2010
INVENTOR(S) : Colombi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 924 days.

Signed and Sealed this

Twenty-third Day of November, 2010

David J. Kappos

David J. Kappos
*Director of the United States Patent and Trademark Office*